United States Patent [19]

Metrailer et al.

[11] 4,007,092

[45] Feb. 8, 1977

[54] PROCESS FOR PRODUCING LOW SULFUR COKE

[75] Inventors: William J. Metrailer; Walter Weissman, both of Baton Rouge, La.

[73] Assignee: Exxon Research and Engineering Company, Linden, N.J.

[22] Filed: Mar. 18, 1975

[21] Appl. No.: 559,588

[52] U.S. Cl. ..... 201/17; 201/20; 48/210; 48/206; 48/197 R; 44/1 R; 208/97; 208/172

[51] Int. Cl.[2] ..... C10B 55/10

[58] Field of Search ..... 201/17; 48/206, 210, 48/197; 44/1 R; 208/97, 172

[56] References Cited

UNITED STATES PATENTS

| | | | |
|---|---|---|---|
| 2,600,430 | 6/1952 | Riblett | 48/197 R X |
| 3,475,323 | 10/1969 | Stuckey, Jr. et al. | 208/97 |
| 3,707,462 | 12/1972 | Moss | 201/17 X |
| 3,912,465 | 10/1975 | Kunii et al. | 48/210 X |

FOREIGN PATENTS OR APPLICATIONS

| | | | |
|---|---|---|---|
| 771,743 | 4/1957 | United Kingdom | 201/17 |

*Primary Examiner*—James H. Tayman, Jr.
*Attorney, Agent, or Firm*—M. L. Gibbons

[57] ABSTRACT

A low sulfur coke product is obtained in an integrated fluid coking and gasification process in which an oxygen-containing gas is introduced into the upper portion of the gasification zone and steam is introduced into the lower portion of the gasification zone. The desired degree of coke desulfurization is controlled by controlling the thickness of the gasifier coke layer on the gaseous reactor leaving solids per pass.

8 Claims, 2 Drawing Figures

PROCESS FOR PRODUCING LOW SULFUR COKE

BACKGROUND OF THE INVENTION

1. Field of the Invention

This invention relates to an integrated fluid coking and gasification process for the production of a low sulfur coke product.

2. Description of the Prior Art

It is known to produce fuel gases and low sulfur coke by integrated fluid coking and gasification processes, such as those disclosed in U.S. Pat. Nos. 3,661,543, 3,702,516 and 3,759,676, the teachings of which are hereby incorporated by reference. In these prior art processes, steam and an oxygen-containing gas are generally introduced into the bottom of the gasification zone to react with the coke therein to produce a fuel gas and a low sulfur coke residue.

It is also known to heat fluid coking beds by injecting oxygen into the upper portion of the bed, as shown in U.S. Pat. No. 3,522,170.

It has now been found that the desulfurization reaction of the coke product can be improved by introducing a portion of the oxygen-containing gas into the upper portion of the gasification zone.

SUMMARY OF THE INVENTION

In accordance with the invention there is provided in an integrated coking and gasification process for the production of low sulfur coke comprising the steps of:

reacting a carbonaceous material containing sulfur contaminants, said carbonaceous material having a Conradson carbon content of at least 5 weight percent, in a coking zone containing a bed of fluidized solids maintained at a temperature ranging from about 850° to about 1,250° F, to form coke containing sulfur contaminants, said coke depositing on said fluidizing solids;

introducing a portion of said solids with the deposition thereon into a heating zone operated at a temperature greater than said coking zone temperature to heat said portion of solids;

recycling a first portion of heated solids from said heating zone to said coking zone and introducing a second portion of said heated solids to a fluid bed gasification zone maintained at a temperature greater than the temperature of said heating zone; and passing a stream of solids from said gasification zone to said heating zone, the improvement which comprises:

circulating and recycling the coke between the heating zone and coking zone, and between the heating zone and gasification zone at rate sufficient to maintain the thickness of a shell of deposited coke, subjected to treatment within the gasification zone in a single cycle, ranging at the time of exit from the gasification zone up to no greater than about 10 microns average thickness, while introducing steam into a lower portion of said fluid bed gasification zone to produce a hydrogen-containing gas and introducing an oxygen-containing gas in the upper portion of said fluid bed gasification zone to convert at least a portion of said hydrogen along with associated carbon monoxide to steam and carbon dioxide and thereby produce at least a portion of the heat requirements of said process, and recovering a partially desulfurized coke.

In the preferred aspects of the invention, the thickness of a shell of deposited coke, subjected to treatment within the gasification zone in a single pass, or cycle, ranges at the time of exit from the coke gasification zone no greater than 5 microns, and preferably from about 2 to about 5 microns, the maintenance of a relatively thin coke shell effecting the greater amount of sulfur removal as contrasted with thicker shells. The thickness of the coke shell is readily maintained, pursuant to the practice of this invention, by control of the rate of coke deposition in the coking zone, rate of coke circulation to the gasification zone, coke particle size distribution and percent coke gasification, all of which variables are interrelated and readily controlled via techniques apparent to those versed in the coking art.

DESCRIPTION OF THE PREFERRED EMBODIMENT

Figure 1:
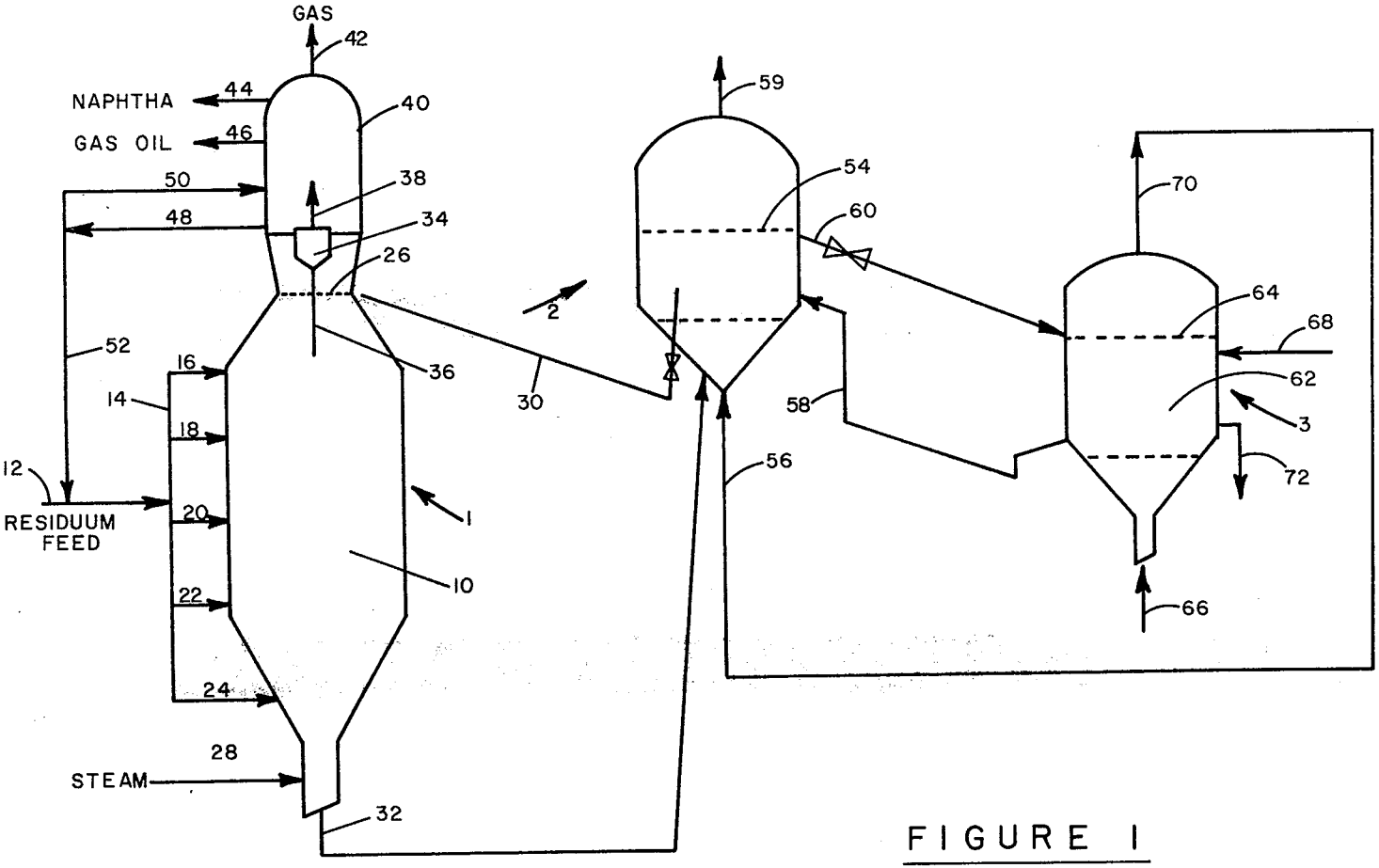
FIG. 1 is a schematic flow plan of one embodiment of the invention wherein the process is conducted in a coking reactor, a heating vessel and a gasifier shown in elevation.

Referring to FIG. 1, a carbonaceous material having a Conradson carbon residue of about 15 weight percent, such as a heavy residuum having an atmospheric boiling point 1050° F.+ is passed into a coking zone 10 by line 12, manifold 14, and multiple feed nozzles represented by lines 16, 18, 20, 22 and 24 into a fluidized bed of solids, e.g., coke particles of 40 to 1000 microns in size having an upper level indicated at 26. Carbonaceous feed suitable for the present invention are heavy or reduced petroleum crudes, atmospheric bottoms, vacuum bottoms, pitch, asphalt, bitumen, other heavy hydrocarbon residua and mixtures thereof. Typically, such feeds have an API gravity of about 0° to 20° and have a Conradson carbon residue of at least 5 weight percent, generally from about 5 to about 50 weight percent, preferably above about 7 weight percent (as to Conradson carbon residue, see ASTM test D-189-65). A fluidizing gas, e.g., steam, is admitted in the base of coking reactor 1 through line 28 in amounts sufficient to obtain a superficial fluidizing gas velocity in the range of 0.5 to 5 feet per second. Coke at a temperature above the actual coking temperature, for example at a temperature 100° to about 800° F. in excess of the actual operating temperature in the coking zone is admitted to the reactor by line 30 in amounts sufficient to maintain the coking temperature in the range of about 850 to about 1250° F. The pressure in the coker is maintained in the range of about 10 to 150 pounds per square inch gauge (psig), preferably in the range of about 10 to 100 psig, more preferably in a pressure not greater than about 45 psig. The lower portion of the coker serves as a stripping zone to remove occluded hydrocarbons from the coke. Coke is withdrawn from this stripping zone by line 32 and is circulated to heater 2. Conversion products are passed through cyclone 34 to remove entrained solids which are returned to the coking zone to dipleg 36. The vapors leave the cyclone through 38 and pass into scrubber-fractionator 40 where they are fractionated to gas leaving by line 42, naphtha by line 44 and gas oil by line 46. A heavy stream is removed through line 48, a portion may be circulated between conventional heat removal exchanges and returned to the scrubber as pumparound by line 50. Another portion is recycled to the coking zone by line 52. A small amount of fine solid particles which pass through the reactor cyclone is returned to the coking zone with this recycle stream.

In heater 2, stripped coke from coking reactor 1 (commonly called cold coke) is introduced by line 32 to a fluid bed of hot coke having a level indicated at 54. The bed may be partially heated by passing a fuel gas into the heater by line 56. (Some oxygen-containing gas may be added into the heater to burn a portion of this gas to provide some of the heat needed to maintain heater 2 at temperature.) Supplementary heat is supplied by coke circulating in line 58. The gaseous effluent of the heater is removed via line 59. Hot coke is removed from the fluidized bed in heater 2 and recycled to the coking reactor by line 30 to supply heat thereto. Another portion of coke is removed from heater 2 by line 60 and passed to a gasification zone 62 in gasifier 3 in which is maintained a bed of fluidized coke having a level indicated at 64.

The gasification zone is maintained at a temperature of at least about 1600° F., preferably at a temperature ranging from about 1700° to about 2000° F. and at a pressure ranging from about 10 to about 150 psig, preferably pressure in the range of about 10 to about 100 psig, more preferably at a pressure not greater than about 45 psig.

Steam is injected into the lower portion of gasifier 3 by line 66, reacting with the carbon in the bed as follows:

$$H_2O + C \leftrightarrows H_2 + CO - 46{,}572 \text{ BTU}$$

A sufficient amount of steam is introduced into the lower portion of the gasification zone to maintain the particles fluidized and to provide a hydrogen concentration ranging up to 40 mol percent, preferably from about 10 to about 30 mol percent. Suitable steam rates include from 0.2 to 1.00 moles of $H_2O$ per mole of carbon gasified. Since the reaction of steam and carbon is highly endothermic, it is necessary to provide sufficient heat in the bed to maintain the desired gasification temperature. Therefore, an oxygen-containing gas, such as air, or air enriched with oxygen, or commercial oxygen is introduced into the upper portion of the bed by line 68 to react with the hydrogen and carbon monoxide which were formed in the lower portion of the bed and to form $H_2O$ and $CO_2$ (exothermic reaction) which therefore provides at least a portion of the heat requirements of the gasification zone. The heat so generated in the upper zone is transferred to the lower zone by natural circulation of the solids in a fluidized bed. This permits the operation of the lower portion of the gasifier at the desired high severity needed to attain significant coke desulfurization while at the same time maximizing coke circulation rate between the gasifier and the heater. At least 15 percent, preferably 50 to 100 percent, of the oxygen introduced into the gasification zone would be introduced in the upper portion of the bed. A portion of oxygen-containing gas can be introduced into the bottom of the gasification zone, with the steam to maintain a uniform temperature in the fluidized bed.

By upper portion is meant herein that the oxygen-containing gas is introduced in the bed within 5 feet, preferably within 2 feet, of the upper surface of the fluidized bed.

The hot fuel gas produced in a gasification zone is removed from gasifier 3 via line 70. If desired, the hot fuel gas may be passed by line 56 to the heater to provide a portion of the the heat therein. Alternatively, the fuel gas could be recovered from the gasifier without passing it through the heater. A low sulfur coke product, that is, a coke product having a lower sulfur content than the coke produced in the coker, is removed from the gasification zone via line 72. It should be noted that the low sulfur coke product produced in the gasifier could be removed from the process by removing a portion from the coke circulating in line 58; or the low sulfur coke product could be withdrawn from the heater at some penalty in sulfur content.

Thus, when the coke produced in a coking reactor has a sulfur content ranging from about 5 to 10 weight percent, the gasification reaction can be carried out for a time sufficient to obtain a coke product having a sulfur content ranging from about 0.7 to about 4 weight percent, that is, a desulfurization of 60 to 85 percent relative to the sulfur present in the coke produced in a coker. Furthermore, the thickness of the layer of product coke remaining per pass on the fluidized solids in the coker gasifier may be controlled to obtain a given level of coke desulfurization in the gasifier. The importance of layer thickness (weight percent coke deposited per pass on the coker solids), and percent sulfur in the gasifier coke are illustrated in the following example.

EXAMPLE

An experimental run simulating the present invention was carried out in a pilot plant constructed to demonstrate an integrated fluid coking and gasification process. The pilot plant consisted of three separate vessels of fluidized solids, a coker, a heater and a gasifier. Each vessel was equipped with an independent means for adding extraneous heat. The coker and the heater vessels were heated electrically and the entire gasifier vessel was enclosed in a furnace. This permitted experimentation with different flow rates of solids between the vessels without greatly affecting the temperature of the various vessels. The availability of additional heat also permitted operating at more severe gasification conditions than would be possible in the conventional heat balanced commercial operation. Feed and operating conditions for this run and a comparative run made with single pass gasification are set forth in Table I.

TABLE I

| Type of Gasification Operation | GFR-7E Single Pass | IKG-5 Multipass |
|---|---|---|
| Sulfur in Residuum Feed to Coker, Wt.% | 3.8 | 4.6 |
| Sulfur in Coker Coke, Wt.% | 5.8 | 7.0 |
| Coke Deposited per Pass to Gasifier, Wt.% | — | 20 |
| Coke Deposit Gasified, Wt.% | 67 | 62 |
| Gasifier Temperature, ° F. | 1795 | 1790 |
| Gasifier Pressure, psig. | 25 | 27 |
| Gasifier Bed Height, Feet | 10.5 | 11.6 |
| Coke Residence Time in Gasifier, Hrs. | 27 | 5.3 |

TABLE I-continued

| Type of Gasification Operation | GFR-7E Single Pass | IKG-5 Multipass |
|---|---|---|
| Mol Ratio of Steam/Air to Gasifier | 0.12 | 0.12 |
| Gasifier Superficial Gas Velocity, Ft./Sec. | 1.1 | 0.4 |
| Hydrogen in Gasifier Off-Gas, Mol.% | 8.5 | 10.8 |
| $CO/CO_2$ in Gasifier Off-Gas, Mol Ratio | 3.0 | 9.3 |
| Product Coke Sulfur Content, Wt.% | 4.95 | 2.2 |
| Coke Desulfurization Attained, Wt.% | 15 | 69 |
| Coke Particle Diameter, Microns | 200 | 240 |

In the single pass operation, product coke from a commercial fluid coker was used in the experiment. The coke was produced from a residuum containing about 3.8 weight percent sulfur and the coke in turn contained 5.8 weight percent sulfur. This coke was charged to the gasifier and the conditions shown in the table were established. The flow rates of coke to and from the gasifier were set to attain a sixty-seven percent gasification of the coke. The coke being withdrawn from this operation contained 4.96 weight percent sulfur which represents only a fifteen percent removal of sulfur.

In the multi-pass operation which simulates this invention, all three vessels were initially charged with the same commercial fluid coke used in the single pass experiment. Fluidization was established and the three vessels heated to establish the desired operating conditions. The coking reactor was maintained at about 990° F., the heater vessel at about 1190° F. and the gasifier at conditions shown in Table I. Circulation of fluid coke between the three vessels was set at a rate per unit of coke gasified that would be achievable in a heat balanced commercial unit operation. A residuum feed containing 4.6 weight percent sulfur was then fed to start generation of new coke product in the system. This new coke product contained 7.0 weight percent sulfur based on the sulfur content of the residuum feed. The coke inventory circulated from the coker to the heater and thence to the gasifier. Part of the new coke, which deposits on the initial coke core, is gasified. The ungasified portion of the new coke remains in the system and causes the diameter of the particle to increase. As the run progressed, the coke inventory in the system increased and the particle size of the coke increased. Coke was removed from the system. Some of the withdrawn coke was ground to a smaller size and then returned to the system to maintain a fluidizable coke particle size distribution. Sufficient coke was taken off as product to maintain a constant inventory in the system. The coke withdrawn from this well mixed fluidized system consists of a mixture of initial coke charged to the system and the new product coke. The amount of new coke in the withdrawn coke increases as the run progresses and the proportions can be predicted by theory. The above operation was continued until the withdrawn coke consisted of about 80 weight percent new coke and twenty weight percent initial coke. The coke product withdrawn at that time contained 2.2 weight percent sulfur. This shows that a significant amount of desulfurization was being obtained during the multipass gasification operation at conditions similar to those used for the single pass run. Further analysis of the coke product from the run show why improved desulfurization was being attained.

Figure 2:
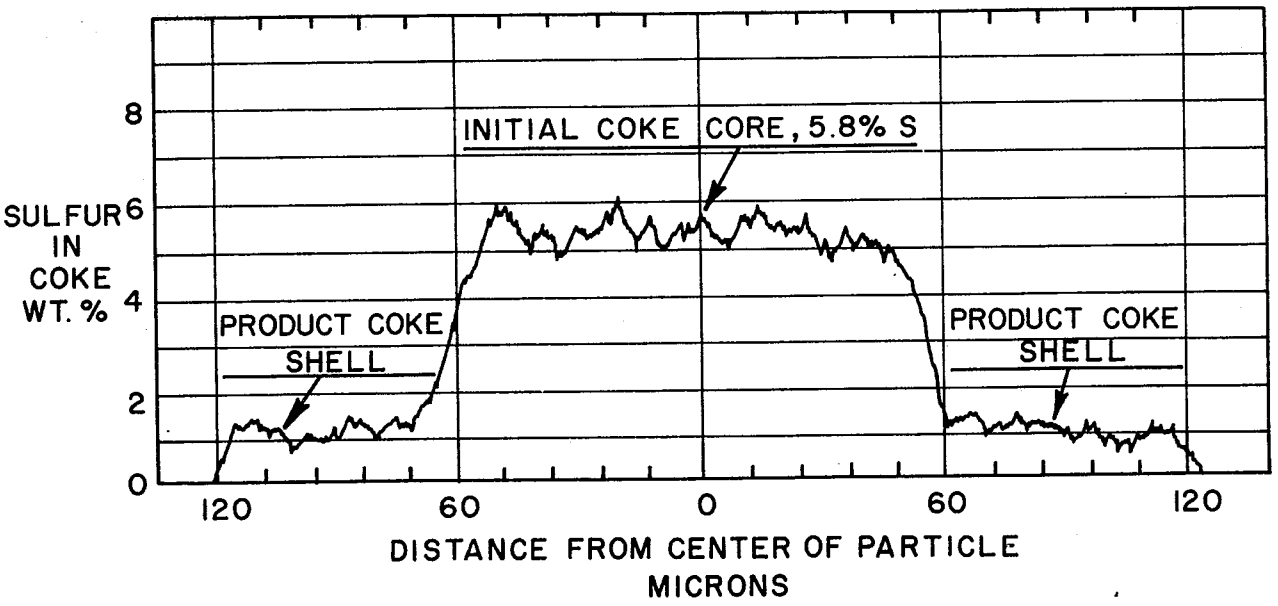
FIG. 2 is a graph showing the weight percent sulfur in the coke versus coke particle depth.

The gasifier coke product of the above given run was analyzed by electron probes of sulfur versus particle depth for individual product coke particles. In this examination, a particle of coke is mounted in plastic, the specimen is positioned to expose a cross-section of a particle and then the exposed section examined by scanning with an electron beam to reflect the concentration of various elements on the surface of the particle. Results from a scan of selected gasifier coke product for sulfur are shown in the graph of FIG. 2. The initial coke charged was commercially produced fluid coke and contained 5.8 weight percent sulfur. As can be seen from FIG. 2, the gasifier product coke contained a core having essentially the same amount of sulfur as the coke charged. The outer layer of the particle represents deposited coke product. It appears to contain only about 1.2 weight percent sulfur whereas a coke containing about 7 weight percent sulfur would be predicted for conventional fluid coking of heavy Arabian residuum feed to this run. This represents an 83 percent desulfurization of the new coke product. Furthermore, desulfurization appears to be occurring preferentially on the surface of the coke particle. In the operation described above, the coke deposition rate, coke particle size distribution, coke circulation rate and percent of new coke gasified was calculated to give a net deposit of new ungasified coke about 3.2 microns thick each time a coke particle exited from the gasification reactor. Thus, by controlling the thickness of the layer of coke built up by each successive pass of the coking and gasification reactions to less than 10 microns, preferably less than 5 microns, and subjecting each layer successively to desulfurization in the gasifier, as the coke particle is being built up, a low sulfur coke product is obtained. Ultimately, when all of the original seed coke has been replaced by coke formed in the process, the entire coke particle can be expected to be desulfurized to the same extent as the outer layer.

In the simulation of the invention, all of the air going to the gasifier was introduced at the bottom and added heat was supplied to the gasifier section by use of a furnace. This was needed in the pilot plant to heat balance with an exit gas $CO/CO_2$ ratio of 9:3 to 1. A feature of this invention is the injection of air into an added upper portion of the fluidized bed of the gasification zone to heat balance the gasification process. Calculations show that, in this particular example, additional oxygen (as air) equivalent to forty-eight percent of the air added to the bottom would be required in an upper zone for a heat balanced operation. The resultant ratio of $CO/CO_2$ in the final leaving gas would be about 1.5 to 1.

What is claimed is:

1. In an integrated coking and gasification process for the production of a low sulfur coke comprising the steps of:

reacting a carbonaceous material containing sulfur contaminants, said carbonaceous material having a Conradson carbon content of at least 5 weight percent in a coking zone containing a bed of fluidized solids maintained at a temperature ranging from about 850° to about 1250° F. to form coke containing sulfur contaminants, said coke depositing on said fluidized solids;

introducing a portion of said solids with the coke deposition thereon into a heating zone operated at a temperature greater than said coking zone temperature to heat said portion of solids;

recycling a first portion of heated solids from said heating zone to said coking zone and introducing a second portion of said heated solids to a fluid bed gasification zone maintained at a temperature of at least 1600° F., and passing a stream of solids from said gasification zone to said heating zone, the improvement which comprises:

controlling the rate of circulation of said solids between each of said zones such as to maintain the thickness of a shell of deposited coke, subjected to treatment within the gasification zone in a single cycle, ranging at the time of exit from the gasification zone to a thickness not greater than 10 microns, while introducing steam into the lower portion of said fluidized bed gasification zone to produce a hydrogen-containing gas and introducing an oxygen-containing gas into the upper portion of said fluid bed gasification zone to convert at least a portion of said hydrogen to steam and thereby produce at least a portion of the heat requirements of said process and recovering a partially desulfurized coke.

2. The process of claim 1 wherein the coke formed in said coking zone contains up to 10 weight percent sulfur and wherein said partially desulfurized coke contains about 60 to 85 percent less sulfur than the coke formed in said coking zone.

3. The process of claim 1 wherein the partially desulfurized coke contains up to about 4 weight percent sulfur.

4. The process of claim 1 wherein at least 15 percent of said oxygen-containing gas is introduced into said upper portion of said gasification zone and the remaining portion of the oxygen-containing gas is introduced into the lower portion of said gasification zone.

5. The process of claim 1 wherein the thickness of said coke deposition per pass through the gasification zone is less than about 5 microns.

6. The process of claim 1 wherein said steam is introduced into said gasification zone at a rate varying from about 0.20 to about 1.00 moles per mole of carbon gasified.

7. The process of claim 1 wherein the concentration of hydrogen in said gasification zone ranges up to about 40 mol percent.

8. The process of claim 1 wherein said gasification is maintained at a temperature ranging from about 1700° to about 2000° F.

* * * * *